US008162416B2

(12) United States Patent
Green

(10) Patent No.: US 8,162,416 B2
(45) Date of Patent: Apr. 24, 2012

(54) ANTI-TIP SYSTEM FOR ADJACENT DRAWERS

(75) Inventor: John M. Green, East Otto, NY (US)

(73) Assignee: Bush Industries, Inc., Jamestown, NY (US)

( * ) Notice: Subject to any disclaimer, the term of this patent is extended or adjusted under 35 U.S.C. 154(b) by 114 days.

(21) Appl. No.: 12/637,170

(22) Filed: Dec. 14, 2009

(65) Prior Publication Data

US 2010/0148648 A1 Jun. 17, 2010

Related U.S. Application Data

(60) Provisional application No. 61/122,424, filed on Dec. 15, 2008.

(51) Int. Cl.
*A47B 88/00* (2006.01)

(52) U.S. Cl. ..... 312/221; 312/333

(58) Field of Classification Search ..... 312/333, 312/330.1, 215, 222, 201, 221; 292/DIG. 65, 292/1, 230, 231, 238, 194, 195, 202, DIG. 4
See application file for complete search history.

(56) References Cited

U.S. PATENT DOCUMENTS 2,655,422 A * 10/1953 Gussack ..... 312/333
3,538,724 A * 11/1970 Dauenbaugh ..... 70/86
3,666,342 A * 5/1972 Biesecker ..... 312/333
3,782,800 A * 1/1974 Remington et al. ..... 312/333
3,900,236 A * 8/1975 Goulish et al. ..... 312/217
3,957,324 A * 5/1976 Klenik et al. ..... 312/218
3,969,008 A * 7/1976 Pergler ..... 312/221
4,155,610 A * 5/1979 Englund ..... 312/222
4,268,076 A * 5/1981 Itoi ..... 292/216
4,453,743 A * 6/1984 Sanders et al. ..... 281/18
4,525,012 A * 6/1985 Dunner ..... 312/222
4,889,396 A * 12/1989 Mitchell et al. ..... 312/221
4,983,000 A * 1/1991 Rock ..... 312/333
5,176,436 A * 1/1993 Mitchell ..... 312/221
5,199,774 A * 4/1993 Hedinger et al. ..... 312/219
5,281,022 A * 1/1994 Rock ..... 312/348.4
5,303,994 A * 4/1994 Elsholz ..... 312/221
5,386,636 A * 2/1995 Asano ..... 312/319.2
5,702,167 A * 12/1997 Muller ..... 312/221
6,979,067 B2 * 12/2005 Yang ..... 312/334.46
7,210,198 B2 * 5/2007 Hoshide et ..... 16/96 R
7,210,752 B2 * 5/2007 Dubon ..... 312/333
7,229,142 B2 * 6/2007 Lin ..... 312/333
7,240,976 B2 * 7/2007 Kluser et al. ..... 312/223.2
7,374,260 B2 * 5/2008 Lu ..... 312/333
7,380,410 B2 * 6/2008 Rand et al. ..... 62/302
7,404,611 B1 * 7/2008 Que ..... 312/334.46

(Continued)

*Primary Examiner* — Darnell Jayne
*Assistant Examiner* — Hiwot Tefera
(74) *Attorney, Agent, or Firm* — The Webb Law Firm

(57) ABSTRACT

An anti-tip system for a piece of furniture having adjacent drawers, including a center panel having an aperture extending therethrough, a left drawer, and a right drawer, wherein the drawers each have a control member attached thereto. The invention includes a shuttle pin extending through the aperture, wherein the shuttle pin has a left end extending from the left side of the center panel and a right end extending from the right side of the center panel. The invention also includes a left wedge and a right wedge associated, whereby the wedge associated with one drawer is adapted, when the drawer is opened, to move the shuttle pin within the aperture and into the path of the control member of the adjacent drawer, thereby blocking the travel of the adjacent drawer. The invention is also directed to a method of utilizing such an arrangement.

16 Claims, 14 Drawing Sheets

U.S. PATENT DOCUMENTS

| | | | | |
|---|---|---|---|---|
| 7,484,817 | B2 * | 2/2009 | Hoffman et al. | 312/219 |
| 7,513,581 | B1 * | 4/2009 | Baiza et al. | 312/333 |
| 7,654,624 | B2 * | 2/2010 | Huang et al. | 312/333 |
| 7,665,813 | B2 * | 2/2010 | Wang | 312/220 |
| 7,770,944 | B2 * | 8/2010 | Yuan | 292/195 |
| 7,850,259 | B2 * | 12/2010 | Chen et al. | 312/221 |
| 7,871,139 | B2 * | 1/2011 | Yu et al. | 312/333 |
| 2003/0184197 | A1 * | 10/2003 | Lai | 312/333 |
| 2005/0023941 | A1 * | 2/2005 | Chiu | 312/221 |
| 2005/0104485 | A1 * | 5/2005 | Chiu | 312/221 |
| 2006/0266746 | A1 * | 11/2006 | Wang | 220/3.2 |
| 2006/0284531 | A1 * | 12/2006 | Dubon | 312/333 |
| 2007/0013274 | A1 * | 1/2007 | Hoffman | 312/219 |
| 2008/0074017 | A1 * | 3/2008 | Ruan et al. | 312/221 |
| 2008/0143224 | A1 * | 6/2008 | Huang | 312/333 |
| 2008/0231153 | A1 * | 9/2008 | Cho | 312/333 |
| 2009/0179534 | A1 * | 7/2009 | Chen et al. | 312/221 |

* cited by examiner

ANTI-TIP SYSTEM FOR ADJACENT DRAWERS

CROSS-REFERENCE TO RELATED APPLICATIONS

This application claims the benefit of Unites States Provisional Application No. 61/122,424, filed Dec. 15, 2008.

BACKGROUND OF THE INVENTION

1. Field of the Invention

The present invention relates to furniture, and in particular, to a system that prevents two adjacent drawers of a furniture piece from being in the open position at the same time.

2. Description of Related Art

A problem that can arise during the use of furniture with drawers is that when two drawers are in the open position, the combined weight of the drawers, alone or in combination with their contents, shifts the center of gravity of the furniture. This shifting can cause the furniture to tip over.

SUMMARY OF THE INVENTION

The present invention is directed toward preventing two adjacent drawers from being in the open position at the same time. The invention is an anti-tip system for a piece of furniture having adjacent drawers including a center panel having a right side, a left side, and an aperture extending therethrough along a longitudinal axis generally perpendicular to each side. The system includes a left drawer having an outside wall adjacent to the left side of the center panel, wherein the wall of the left drawer has a left control member attached thereto, as well as a right drawer having an outside wall adjacent to the right side of the center panel, wherein the outside wall of the right drawer has a right control member attached thereto. The system has a shuttle pin extending through the aperture, wherein the shuttle pin has a left end extending from the left side of the center panel and a right end extending from the right side of the center panel. The system also includes a left wedge secured to the left side of the center panel and a right wedge secured to the right side of the center panel, whereby when one drawer is open, the shuttle pin is displaced by the wedge associated with the open drawer through the aperture to engage a stop and prevent motion of the control member associated with the closed drawer, thereby blocking the travel of the closed drawer.

Another embodiment of the subject invention is directed to a method for preventing adjacent drawers of a furniture piece from being simultaneously in the open position. The method comprises the steps of providing a center panel having a right side, a left side, and an aperture extending therethrough along a longitudinal axis generally perpendicular to each side. A left drawer is provided having an outside wall adjacent to the left side of the center panel, wherein the outside wall of the left drawer has a left control member attached thereto. A right drawer is provided having an outside wall adjacent to the right side of the center panel, wherein the outside wall of the right drawer has a right control member attached thereto. A shuttle pin is provided extending through the aperture, wherein the shuttle pin has a left end extending from the left side of the center panel and a right end extending from the right side of the center panel. A left wedge is provided and secured to the left side of the center panel and a right wedge is provided and secured to the right side of the center panel. When one drawer is open, the shuttle pin is displaced by the wedge associated with the open drawer through the aperture to engage a stop and prevent motion of the control member associated with the closed drawer, thereby blocking the travel of the closed drawer.

These and other features and characteristics of the present invention, as well as the methods of operation and functions of the related elements of structures and the combination of parts and economies of manufacture will become more apparent upon consideration of the following description and the appended claims with reference to the accompanying drawings, all of which form a part of this specification, wherein like reference numerals designate corresponding parts in the various figures. As used in the specification and the claims, the singular form of "a", "an" and "the" include plural referents unless the context clearly dictates otherwise.

DESCRIPTION OF THE PREFERRED EMBODIMENTS

Figure 1:
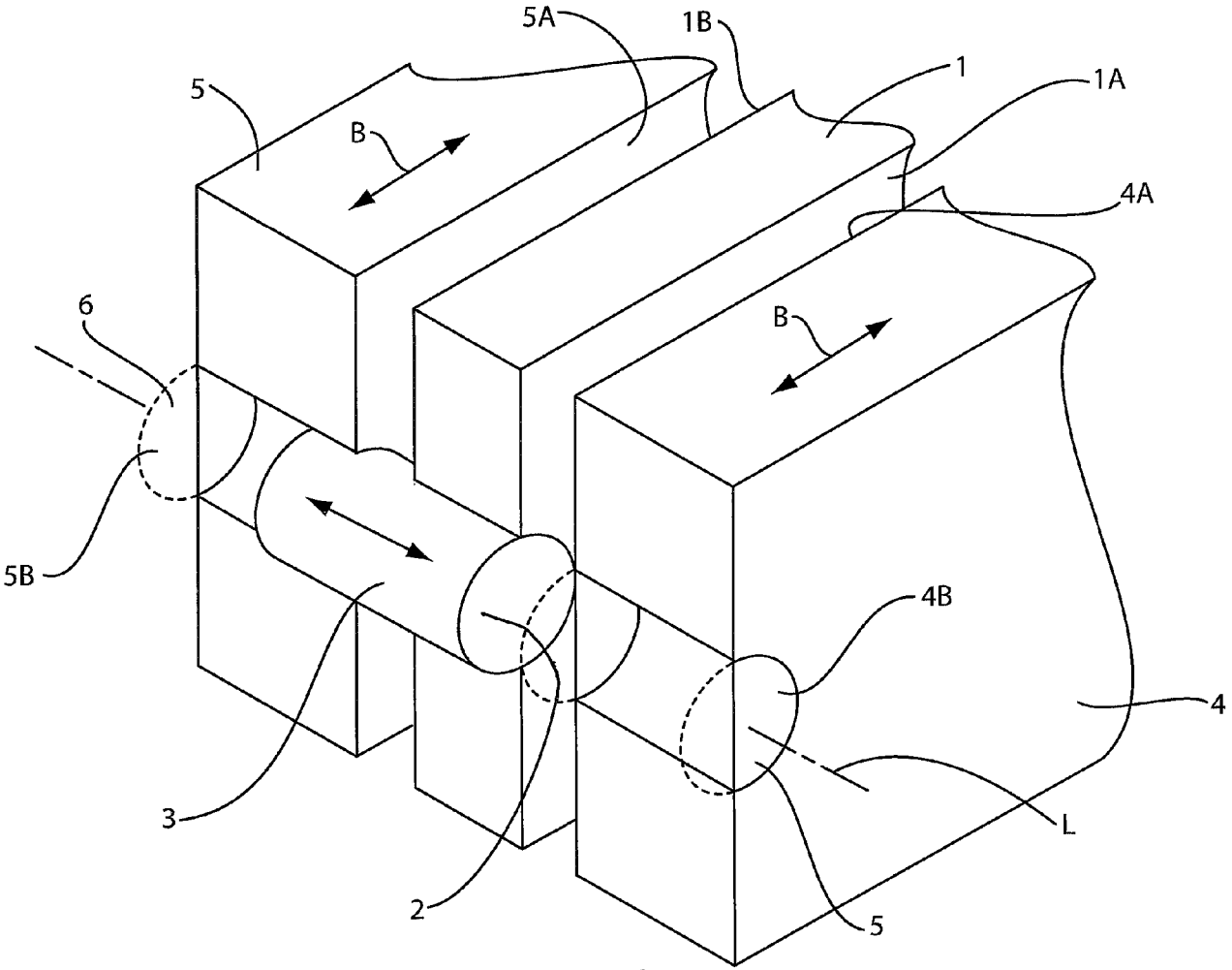
FIG. 1 is a perspective schematic view showing the general operation of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

FIG. 1 discloses the broad concept of the present invention by way of a simplified schematic. Essentially, there is a center panel 1 having an aperture 2 with a shuttle pin 3 through it. The aperture 2 extends through the central panel 1 along a longitudinal axis L generally perpendicular to the sides 1A, 1B of the center panel 1. The shuttle pin 3 is adapted to move along arrow A through the aperture 2. Adjacent to the sides 1A, 1B of the center panel 1 are a right drawer 4 with an outer wall 4A and a left drawer 5 with an outer wall 5A. Each drawer outer wall 4A, 5A may have a drawer aperture 4B, 5B adapted to receive the shuttle pin 3. The shuttle pin 3 can move back and forth in a direction along arrow A to engage with one of the two apertures 4B, 5B. As shown in FIG. 1, when the shuttle pin 3 is engaged with the aperture 5B of the left drawer 5, the shuttle pin 3 prevents movement of the left drawer 5 in direction B because the shuttle pin 3 fixes the left drawer 5 relative to the center panel 1. By contrast, the shuttle pin 3 is not engaged with the right drawer 4 so it is free to move in direction B. By moving the shuttle pin 3 to engage and fix the respective drawers 4, 5, one drawer can be opened while the other is locked stationary. This example of the present inventive concept is not deemed to be limiting, and will be further explained with reference to the following disclosure of the preferred embodiments.

Figure 2:
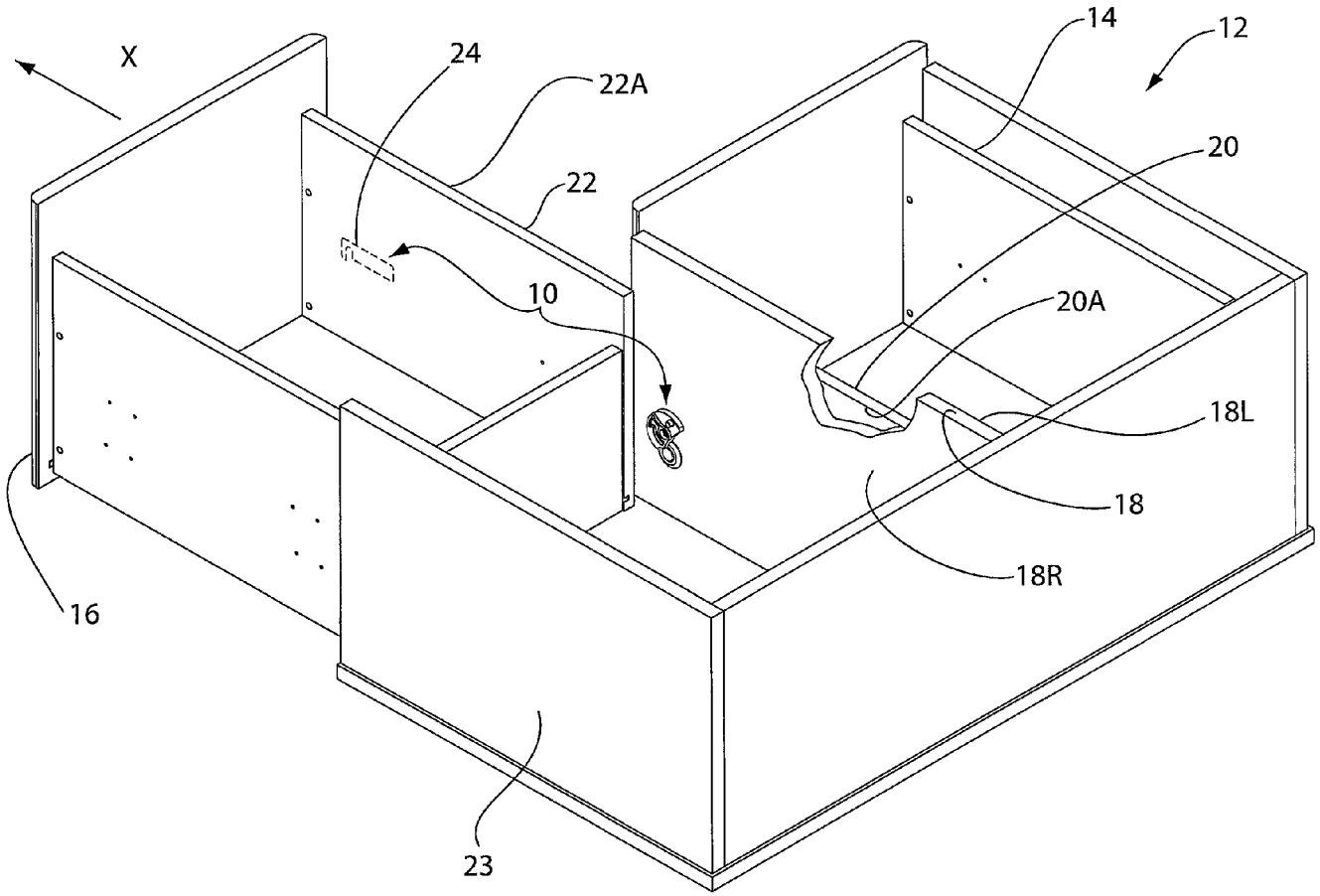
FIG. 2 is a perspective view of an anti-tip system as installed into a piece of furniture with two adjacent drawers, namely a left drawer and a right drawer.
Figure 3:
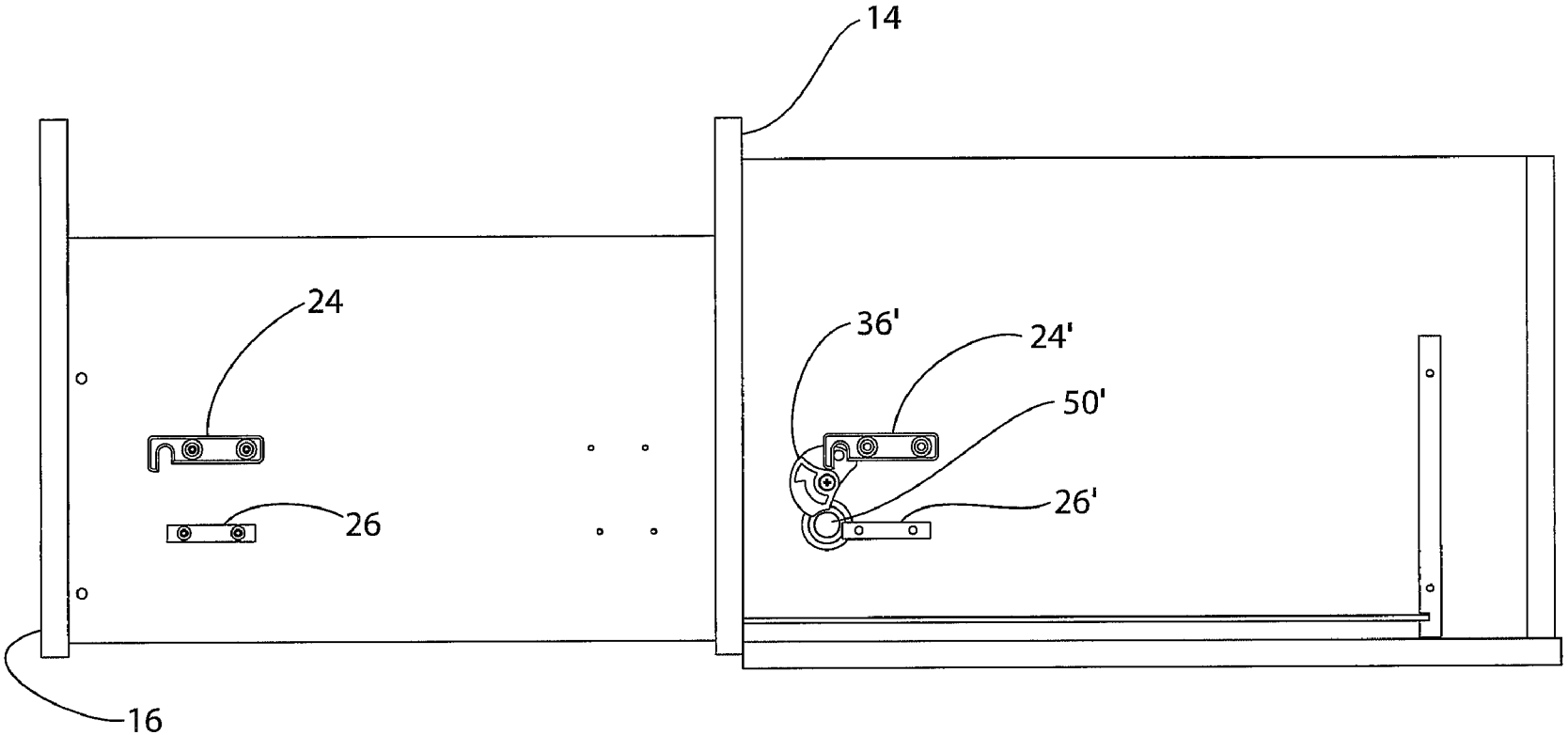
FIG. 3 is a side view of the system and piece of furniture shown in FIG. 2, with the right drawer open and looking through the side drawer panels.

Referring now to FIGS. 2 and 3, the present invention is directed to an anti-tipping system 10 for a piece of furniture 12 having a left drawer 14 and a right drawer 16. The drawers 14, 16 are horizontally aligned with each other, but are separated by and are each adjacent to a center panel 18. Adjacent and parallel to the left side 18L of the center panel 18 is an inner panel 20 on the left drawer 14 with an outer wall 20A. Adjacent and parallel to the right side 18R of the center panel 18 is an inner panel 22 on the right drawer 16 with an outer wall 22A. FIG. 2 shows a cutaway view of the center panel 18 showing the outer wall 20A of the inner panel 20 of the left drawer 14. The furniture drawers 14, 16 and the center panel 18 can be made of wood, plastic, metal, or any other suitable material for furniture.

Figure 4A:
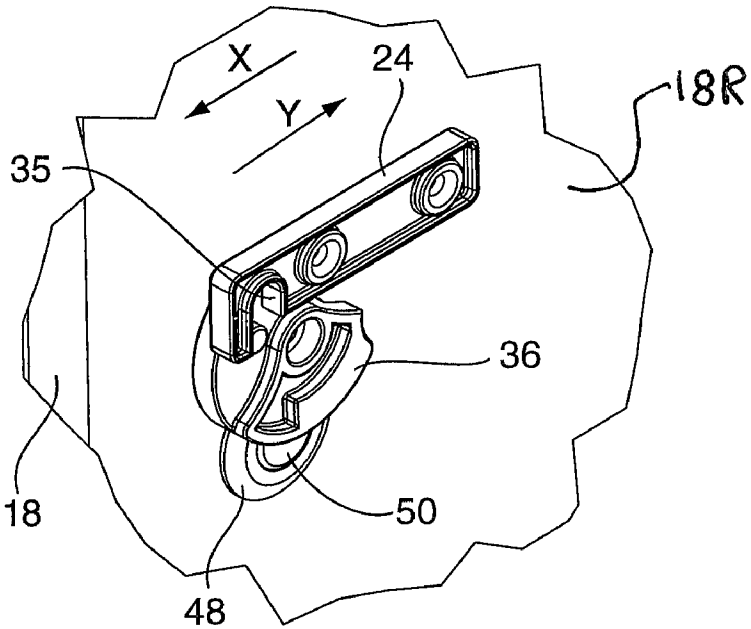
FIG. 4A is a perspective view of the anti-tip system with the right drawer in the partially open position.
Figure 4B:
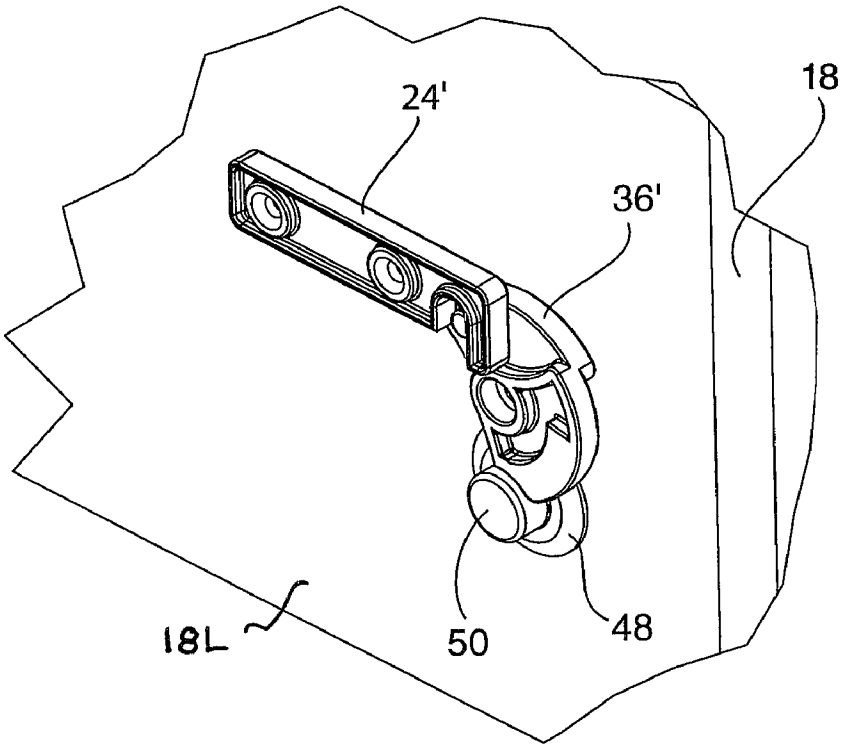
FIG. 4B is a perspective view of the anti-tip system with the left drawer in the closed/locked position.
Figure 7:
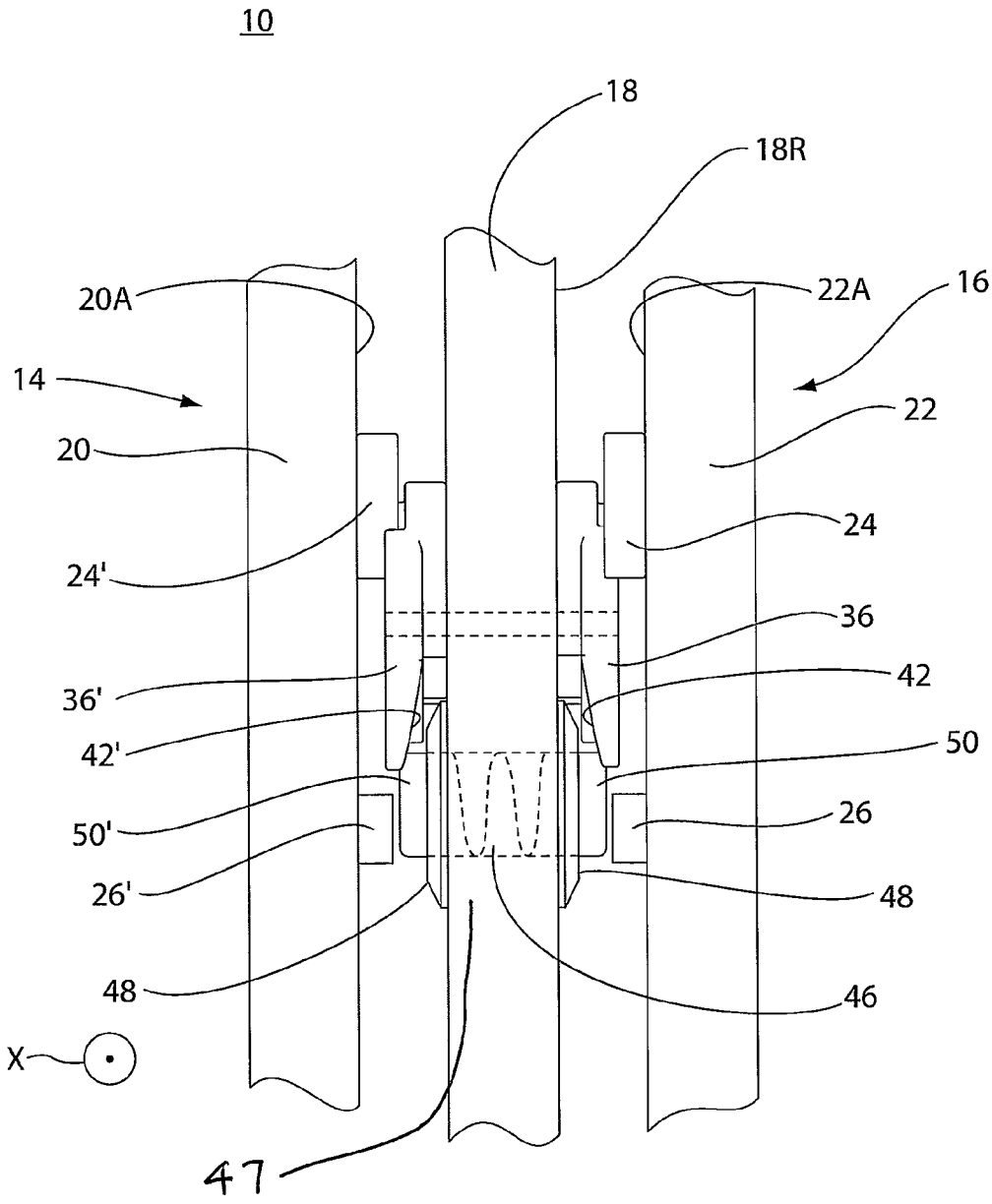
FIG. 7 is a front view of a center panel of the furniture shown in FIG. 2 having the anti-tip system installed.

FIGS. 4A and 4B show the system 10 in a perspective view of the right side 18R and left side 18L of the center panel 18. A control member 24 is attached to the outer wall 22A (FIG. 7) of the right drawer 22, while the control member 24' is attached to the outer wall 20A (FIG. 7) of the left drawer 20. FIG. 7 is a view of a portion of the two drawers 14, 16 in the closed position with pistons 50, 50' of the shuttle pin 46 not engaging the stop 45, 45' of either rotational wedge 36, 36' or of either stop 45, 45'. It should be noted that FIGS. 4A and 4B do not show the blocking elements 26, 26'.

Figure 5B:
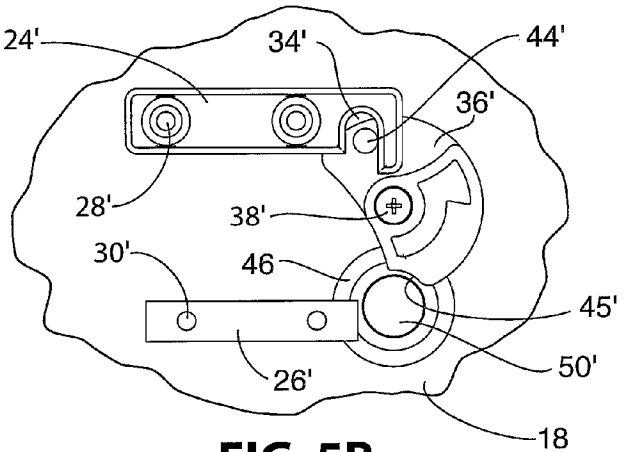
FIG. 5B is a side view of the anti-tip system as viewed from the left drawer panel in the closed position.
Figure 5A:
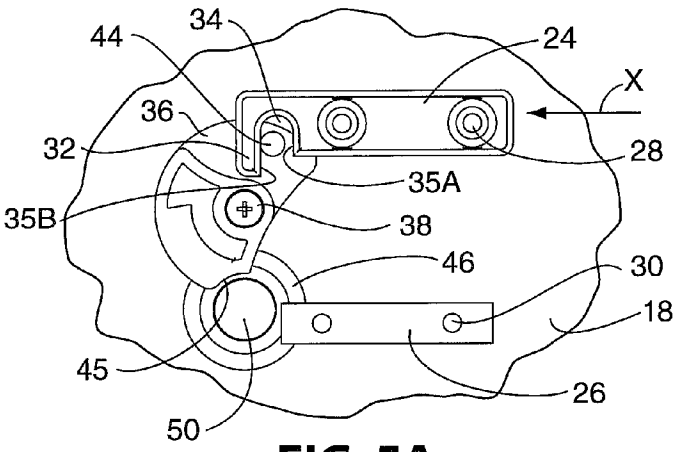
FIG. 5A is a side view of the anti-tip system as viewed from the right drawer panel in the closed position.

FIGS. 5A and 5B show side views of the portions of the system 10 associated with the right drawer 16 (FIG. 7) and left drawer 14 (FIG. 7), respectively, as they are attached to the center panel 18. Each drawer 14, 16 is in the closed position. The system 10 includes a right control member 24 and may include a right blocking element 26, both of which are attached to the outer wall 22A of the right panel 22 as shown in FIG. 7. The right panel 22 is not shown in FIG. 5A, since FIG. 5A is a view looking through the right panel 22 toward the center panel 18. The control members 24, 24' and the blocking elements 26, 26' appear to be floating in all of the FIGS. 5A, 5B, 6A, and 6B. However, these elements are mounted to the outer walls 20A and 22A, as better illustrated in FIG. 7.

Referring to FIG. 3, the control member 24 and the blocking element 26 are attached to the right drawer 16 so that the control member 24 and the blocking element 26 travel with the right drawer 16.

Referring again to FIG. 7, the control member 24 and blocking element 26 can be attached to the panel 22 with screws or nails through right control member holes 28 (FIG. 5A) and right blocking element holes 30 (FIG. 5A), respectively. Various other methods of attachment are well known in the art, including, but not limited to, the use of adhesives. As shown in FIG. 5B, the corresponding left control member 24', left blocking element 26', left control member holes 28', and left blocking element holes 30' have been given similar reference numbers just as other essentially mirror image components will.

Referring again to FIGS. 5A and 5B, the system 10 also includes a right rotational wedge 36 and a mirror image left rotational wedge 36'. Perspective views of the rotational wedges 36, 36' are shown in FIGS. 9A-10B. The rotational wedge 36 is generally a semicircular disc-shaped component having a hole 38 near the center of the disc. The rotational wedges 36, 36' are attached to the center panel 18 through holes 38, 38'. This attachment can be with a screw or nail, or any other method known in the art so that they may rotate about the pivot point created by the holes 38, 38'. The rotational wedges 36, 36' can be made of metal, plastic, or any other suitably rigid material.

Figure 9A:
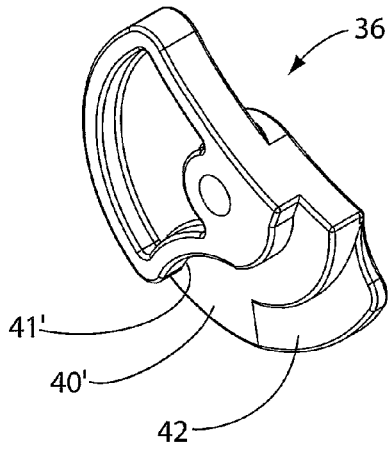
FIG. 9A is a perspective view of the inner side of the rotational wedge associated with the right drawer panel.
Figure 9B:
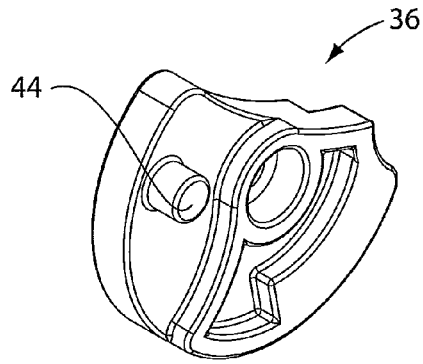
FIG. 9B is a perspective view of the outer side of the rotational wedge shown in FIG. 9A.
Figure 10A:
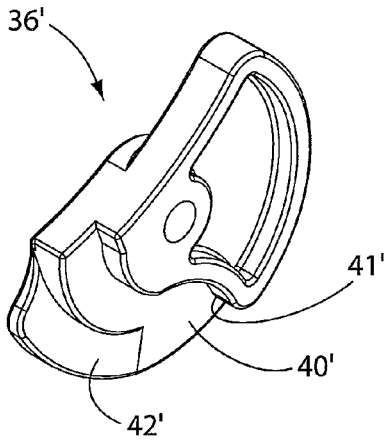
FIG. 10A is a perspective view of the inner side of the rotational wedge associated with the left drawer panel.
Figure 10B:
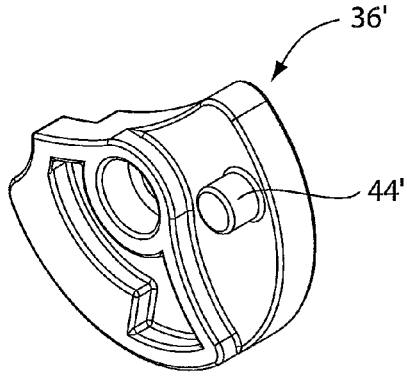
FIG. 10B is a perspective view of the outer side of the rotational wedge shown in FIG. 10A.

Referring to FIG. 9A, the inside surface of the rotational wedge 36 is recessed in the lower portion of the rotational wedge 36 to create plateau 40, which is a substantially flat surface. The recession of the plateau 40 includes a protrusion 41 in the form of a substantially arc-shaped bumper positioned radially outward from the hole 38. At the bottom of the rotational wedge 36 and peripherally adjacent to the plateau 40 is a ramp 42 which covers about half the area of the recessed portion of the rotational wedge 36. The ramp 42 gradually tapers from the plateau 40 along the circumference of the rotational wedge 36 to form a wedge shape. Referring to FIG. 9B, the outside surface of the rotational wedge 36 includes a post 44 that extends perpendicularly outward from the outside surface of the rotational wedge 36 and is adapted to fit into the cavity 34 (FIG. 5A) of the hook 32 on the control member 24. In FIGS. 5A and 5B, the rotational wedges 36, 36' also include stops 45, 45' that are concavely curved portions along the circumference of the rotational wedges 36, 36'. The stops 45, 45' are shaped to generally conform to the outer surface of the pistons 50 of the shuttle pin 46. The side views of the rotational wedges 36, 36' in FIGS. 5A and 5B represent views looking toward the center panel 18 with the drawer outer walls 20A, 22A treated as being transparent.

FIG. 7 shows a front view of the system 10 with the rotational wedges 36, 36' attached to the center panel.

Figure 13:
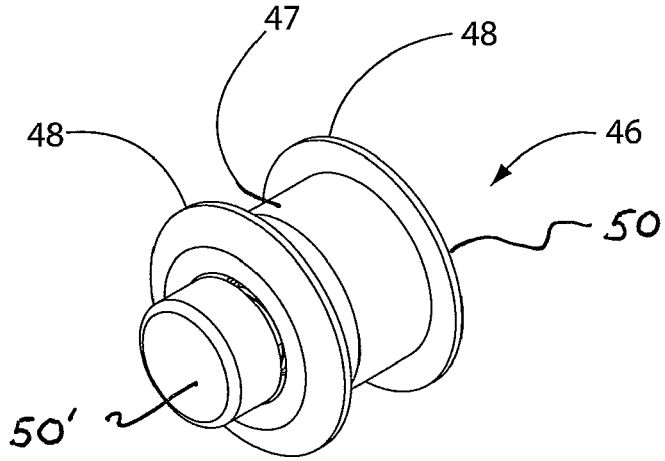
FIG. 13 is a perspective view of an assembled shuttle pin.
Figure 14:
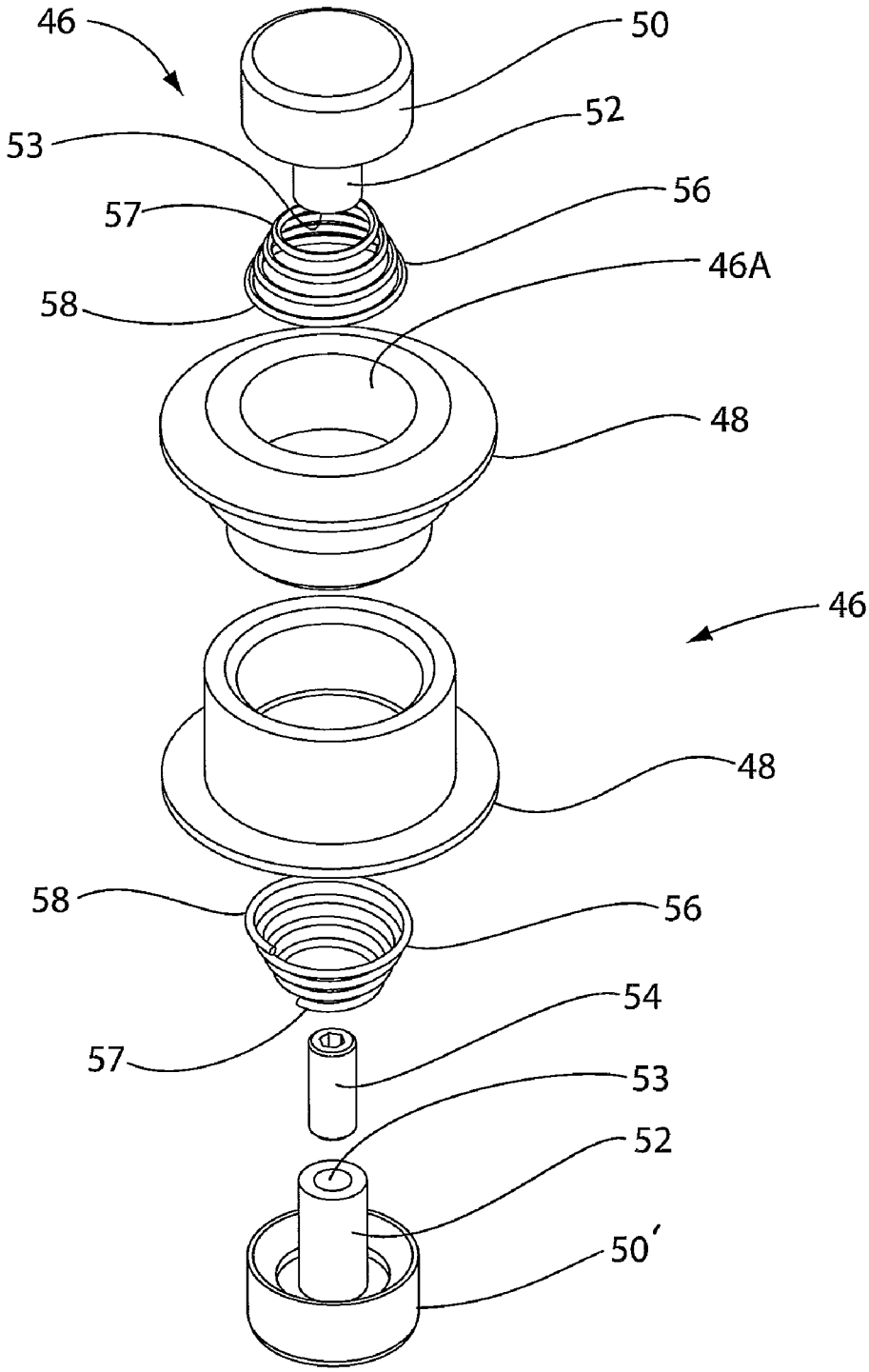
FIG. 14 is an exploded view of the shuttle pin shown in FIG. 13.

As shown in FIGS. 13 and 14, the shuttle pin 46 has a channel 47 that is generally cylindrical. The shuttle pin 46 defines a bore 46A surrounded by the channel 47, and includes a lip 48 at each end which is generally ring-shaped. The lips 48 each have a radius greater than that of the channel 47. As illustrated in FIG. 7, the channel 47 extends through the center panel 18 and the lips 48 abut with the left side 18L and the right side 18R of the center panel 18. The channel 47 has a length equal to the width of the center panel 18 and is adapted to fit into a hole in the center panel 18 that is substantially the same diameter as the channel 47. Because the lips 48 have a greater radius than the channel 47 and are flush with the surface of the center panel 18, the lips 48 prevent the channel 47 from any horizontal movement relative to the center panel 18.

The shuttle pin 46 also includes two pistons 50, 50' adapted with a diameter to fit within the bore 46A surrounded by the channel 47 and the ring-shaped lips 48.

Referring to FIG. 14, the pistons 50, 50' are substantially cylindrical, with a smaller cylindrical peg 52 extending axially therefrom. The shuttle pin 46 also includes a substantially cylindrical post 54 with a diameter less than that of the pegs 52. The shuttle pin 46 also includes coil springs 56, each one having a small end 57 and a large end 58. The small ends 57 have a diameter larger than that of the pegs 52 but smaller than that of the pistons 50. The large ends 58 of the springs 56 have a diameter larger than the pegs 52 but smaller than the bore of the channel 47. The springs 56 therefore are disposed around the pegs 52 and can provide outwardly biasing force between the pistons 50, 50' within the bore 46A.

Fully assembled, the large ends 58 of the springs 56 are attached to the inside of the channel 47, substantially at its center. The post 54 fits into holes 53 at the inner ends of the pegs 52 to attach the two pegs 52 together via frictional engagement between the post 54 and the holes 53 or via other means of attachment known in the art, such as gluing. The pistons 50, 50' are therefore biased by the springs 56 to remain in a neutral position, each equally and partially protruding from the lips 48 of the shuttle pin 46. This neutral position of the pistons 50, 50' is shown in FIG. 7. When a piston 50 is pressed into the bore 46A of the channel 47, they compress the spring 56 and push the post 54 into the opposite peg 52 of they opposite piston 50, causing the opposite piston 50 to extend outward from the lip 48. This position with one piston 50 depressed and the other extended is shown in FIG. 13. Once the depressed piston 50 is released, the opposing springs 56 will bring the pistons 50, 50' back to their neutral positions.

As stated, FIG. 7 shows the system 10 when both drawers 14, 16 are in the closed position and the shuttle pin 46 is in the neutral position. The ramps 42, 42' on the rotational wedges 36, 36' are spaced over the lips 48 of the shuttle pin 46 and adjacent to the pistons 50. The angle of the ramps of the rotational wedges 36, 36' is such that the ramps 42, 42' may easily rotate over and compress the pistons 50, 50' when the shuttle pin 46 is moved from its neutral position. As is shown in FIGS. 5A and 5B, the stops 45, 45' of the rotational wedges 36, 36' near the ramps 42, 42' are curved in a concave manner to complement and follow the circumference of the pistons 50, 50'. As also illustrated in FIGS. 5A and 5B, the posts 44, 44' are engaged with the cavities 34, 34' of the control members 24, 24'.

Figure 11:
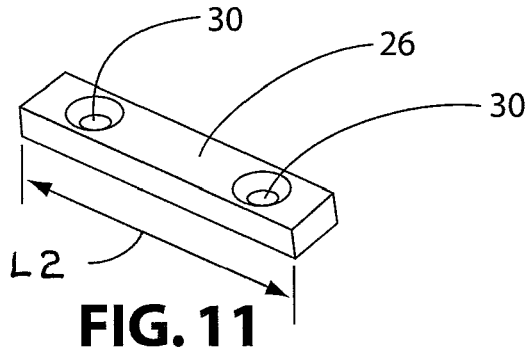
FIG. 11 is a perspective view of a stop.
Figure 12:
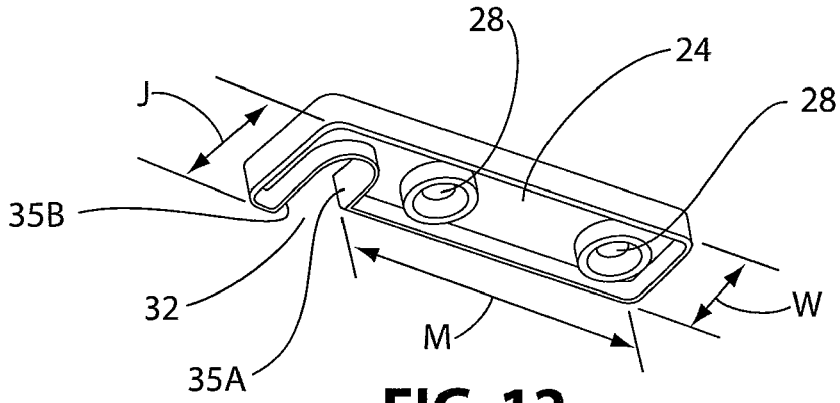
FIG. 12 is a perspective view of a control member.

As shown in FIG. 11, the blocking element 26 is generally rectangular, having two holes 30 near opposite ends of its length L2. As shown in FIG. 12, the control member 24 is also generally rectangular having holes 28 at the opposite ends of its length M. The control member 24 also has a hook 32 that extends beyond one of the holes 28, creating a U-shaped cavity 34 having a short leg 35A or pushing wall. The hook 32 extends in a direction parallel to the side of the control member 24 and begins at a length M past the left hole 28 and extends inwardly. At the top end the hook 32 bends to become substantially parallel with the side of the control member 24 having width W. Long leg 35B has a length J that is parallel to the side of the control member 24 having width W and is greater than the width W of the control member 24.

The manner of operation of the system 10 will now be discussed with reference to the opening of the right drawer 16, but the operation is the same for the opening of the left drawer 14, except that the mirror image components would be involved. For example, directing attention to FIGS. 5A and 5B, discussion of the right control member 24 engaging with the right post 44 to rotate the right rotational wedge 36 would be likewise performed by having the left control member 24' engage the left post 44' to rotate the left rotational wedge 36'.

Referring to FIGS. 2, 5A, and 7, the left drawer 14 with the inner panel 20 is initially pulled in direction X. The control member 24' is attached to the inner panel 20, moves in direction X. The shuttle pin 46 with the rotational wedge 36' is attached to the center panel 18 and does not move in the X direction with the control member 24. As the control member 24 moves in direction X, the post 44 (FIG. 5A) is pushed along by the short leg 35A of the cavity 34 causing the rotational wedge 36 to rotate in the counterclockwise direction CD as viewed in FIG. 6A.

Figure 6B:
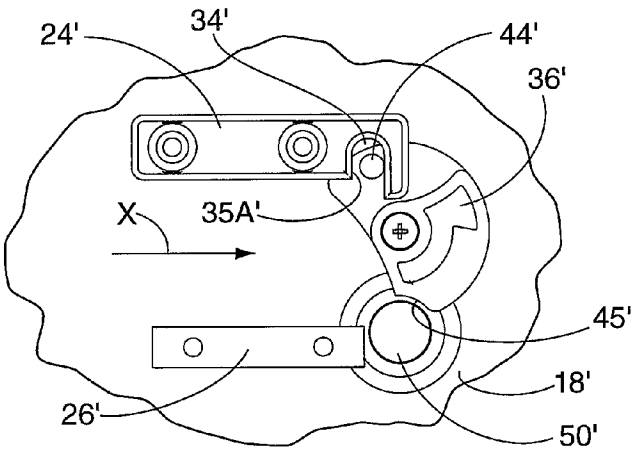
FIG. 6B is a view of the anti-tip system shown in FIG. 5B locked in the closed position by the shuttle pin.
Figure 6A:
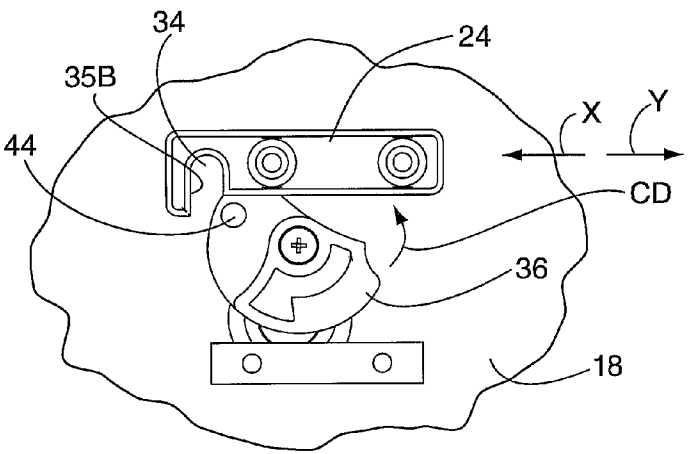
FIG. 6A is a view of the anti-tip system as viewed from the right drawer with the right drawer in the partially opened position.
Figure 8:
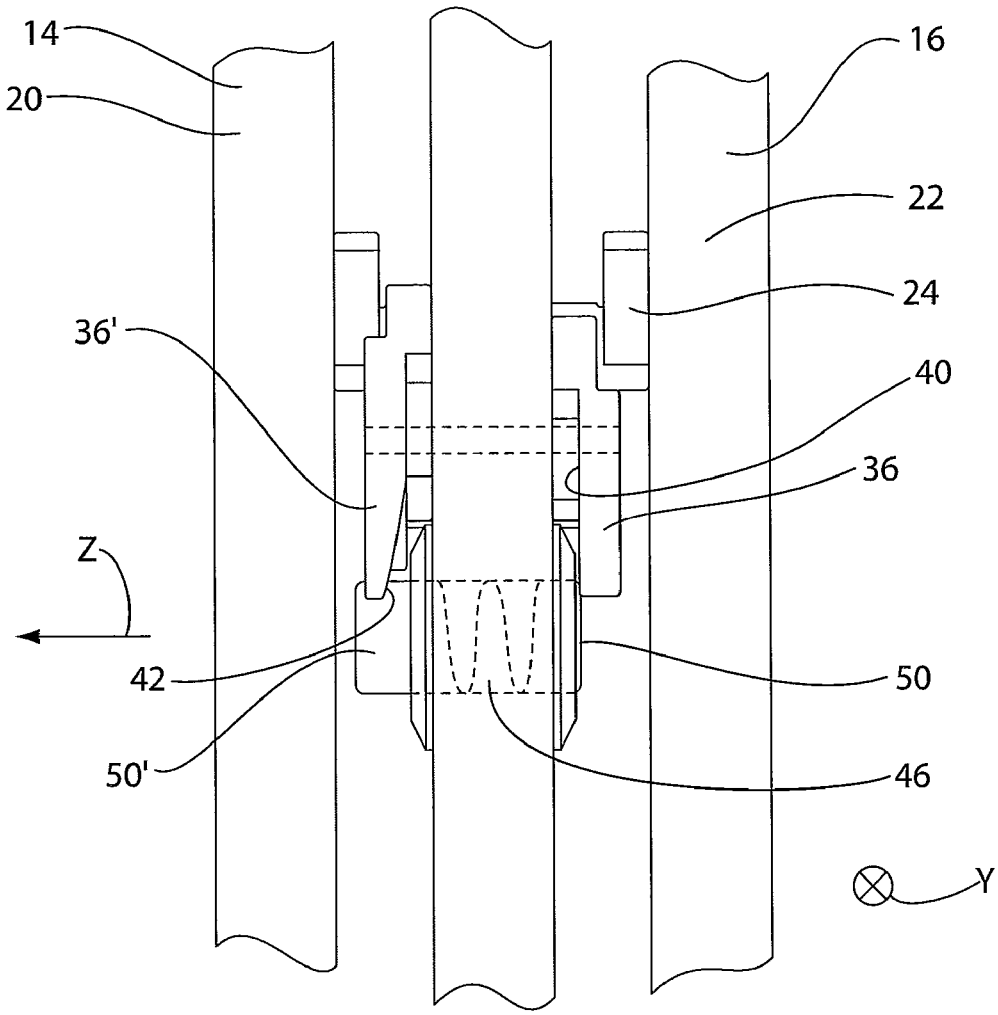
FIG. 8 is a front view of the system shown in FIG. 7 with the shuttle pin displaced from the right side.

When the rotational wedge 36 rotates, the ramp 42 (FIG. 7) moves against the piston 50 of the shuttle pin 46, depressing it toward the inner panel 20 of the left drawer 14 in direction Z (FIG. 8) until the piston 50 on the left side of the shuttle pin 46 is substantially protruding (FIGS. 4B and 8). FIGS. 4A, 6A, and 8 show the rotational wedge 36 having been rotated by the control member 24 to depress the piston 50. Once the rotational wedge 36 has rotated counter-clockwise sufficiently (FIGS. 4A and 6A) that the post 44 has exited the cavity 34, as the right drawer 16 with the right panel 22 continues to open, the control member 24 moves past the rotational wedge 36 in direction X. In this position, the rotational wedge 36 is rotated sufficiently past the ramp 42 to align the piston 50 with the plateau 40 (item 40 of FIG. 9A) of the rotational wedge 36. This is significant because the plateau 40 is a flat surface off of the ramp 42 and perpendicular to the piston 50 face, such that the spring force of the piston 50 against the rotational wedge 36 will not act to rotate the rotational wedge 36 back to its original unlocked position. As a result, the piston 50 is pressed against the plateau 40 (FIGS. 4A, 6A, and 8) of the rotational wedge 36 and the bumper 41 (FIG. 9A) is engaged with the circumference of the piston 50, thereby preventing further rotation of the rotational wedge 36 associated with the inner panel 20 (FIG. 8). The compression of the springs 56 in the shuttle pin 46 should be such that the engagement between the piston 50 and the plateau 40 is sufficient to provide friction and prevent rotation of the rotational wedge 36 back in the clockwise direction. The manner and tightness of affixing the rotational wedge 36 to the center panel 18 at hole 38 (FIG. 5A), (e.g., a screw) can also be adapted to allow the forced rotation of the rotational wedge 36 by the control member 24, but prevent free rotation. Under these circumstances, the plateau 40 of the rotational wedge 36 would not be necessary to prevent undesirable reverse rotation of the rotational wedge 36. With this configuration, illustrated in FIG. 8, the piston 50 associated with the right drawer 16 is depressed, and the piston 50' associated with the left drawer 14 protrudes from the left side 18L of the center panel 18 a sufficient amount to engage the stop 45' of the rotational wedge 36'. The right drawer 16 may be opened to its full extent and the piston 50' will maintain its extended position.

Once the right drawer 16 is opened and the piston 50 has been depressed on the right side, as discussed above, the piston 50' on the left side 18L of the center panel 18 is displaced in direction Z (FIG. 8) beyond its neutral position. The piston 50' extends to interfere with the travel of the stop 45' and prevents rotation of the rotational wedge 36' (FIGS. 8, and 6B). In particular, the piston 50' protrudes to a distance such that it is adjacent to the stop 45' (FIG. 6B) of the rotational wedge 36' on the inner panel 20. When the left drawer 14 is pulled in direction X in an attempt to open it, the short wall 35A' of the cavity 34' of the control member 24' will engage the post 44' and attempt to rotate the rotational wedge 36' in the clockwise direction as viewed in FIG. 6B. However, the rotational wedge 36' will not be able to rotate. Rather, the stop 45' will bump against the protruding piston 50' and prevent any further rotation of the rotational wedge 36'. With the rotational wedge 36' unable to rotate, the post 44' on the rotational wedge 36' is held stationary and translation of the control member 24' is prevented. With the locking surface 45' engaging the piston 50 as described herein, the left drawer 14 is prevented from opening because the control member 24' will not be able to rotate the rotational wedge 36' sufficiently to allow the post 44' to exit the cavity 34'. As an alternate or cumulative measure to prevent the left drawer 14 from opening, a stop 26' may be used. In particular, the stop 26' is attached to the inner panel 20 of the left drawer 14 and aligned with the path of the extended piston 50' such that the piston 50' blocks the translational travel of the stop 26' to prevent the opening of the left drawer 14. Since the control member 24' and/or stop 26' will be prevented from moving in the direction X, the left drawer 14 cannot be pulled open.

Referring to FIGS. 6A and 8, the right drawer 16 can be closed by pushing it in direction Y. As the control member 24 moves in direction Y, the long wall 35B catches the post 44 and pushes against the post 44, causing the rotational wedge 36 to rotate in the clockwise direction. As the rotational wedge 36 rotates, the post 44 is rotated clockwise into the cavity 34 and the ramp 42 moves across the piston 50 until the piston 50 is no longer compressed by the rotational wedge 36 and moves back to the neutral position (FIG. 5A). Since the rotational wedge 36 is no longer compressing the piston 50, the springs 56 in the shuttle pin 46 will return the piston 50' back to its neutral positions shown in FIGS. 5B and 7. Once the pistons 50, 50' of the shuttle pin 46 are back to this position, either drawer 14 or 16 can be opened.

In the manner of operation described above, when the right drawer 16 is in the open position, the left drawer 14 cannot be opened, and vice versa. The risk of furniture tipping over when two drawers are open at the same time is much greater than the risk when only a single drawer is open. Therefore, by allowing only one adjacent drawer to be in the open position at one time, the present system 10 significantly decreases the risk of such furniture toppling over.

So far what has been described is the use of rotational wedges to extend the shuttle pin into the path of one drawer to prevent travel when the adjacent drawer is opened.

Figure 15:
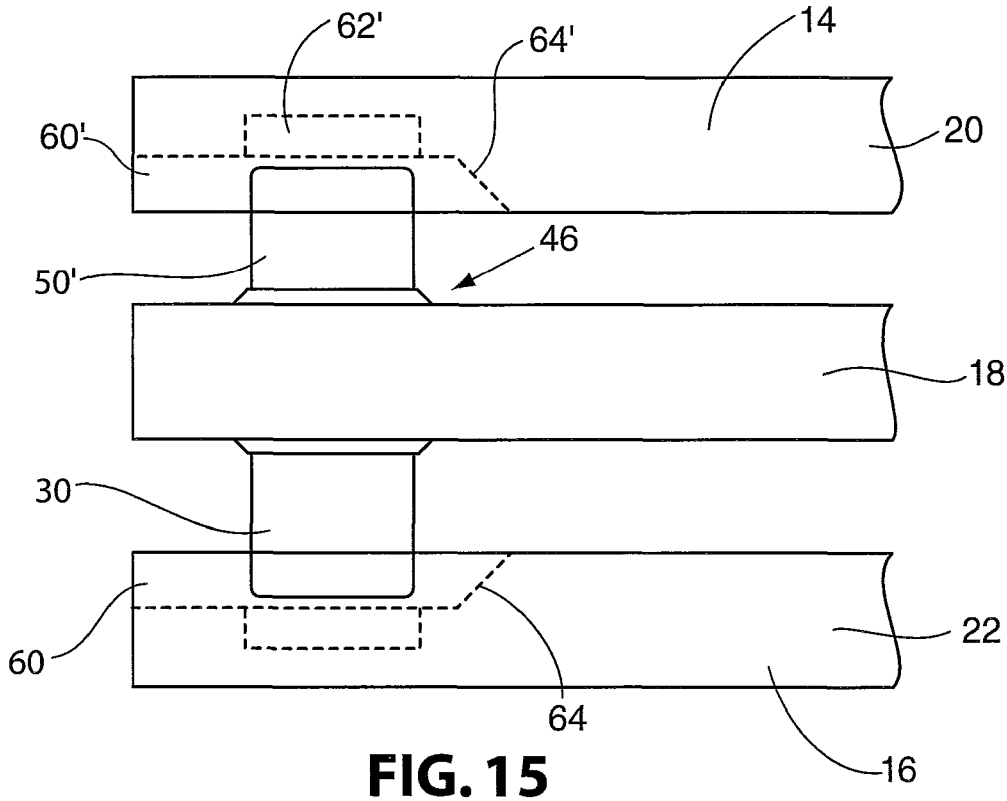
FIG. 15 is a top plan view of another embodiment of the present invention.
Figure 16:
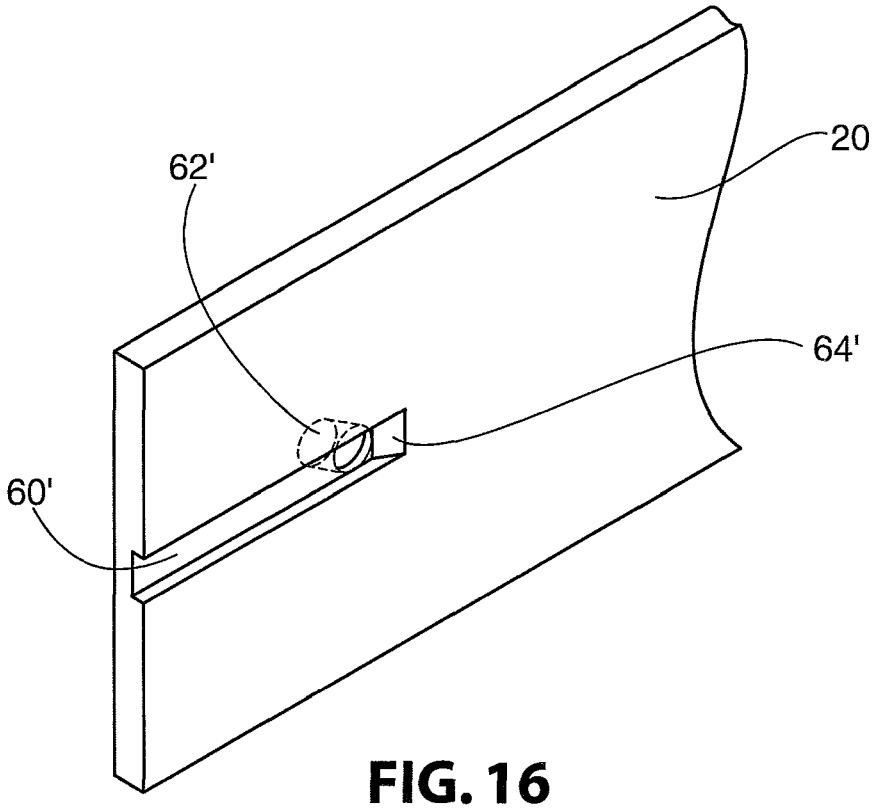
FIG. 16 is a perspective view of a left panel in the embodiment shown in FIG. 15.
Figure 17:
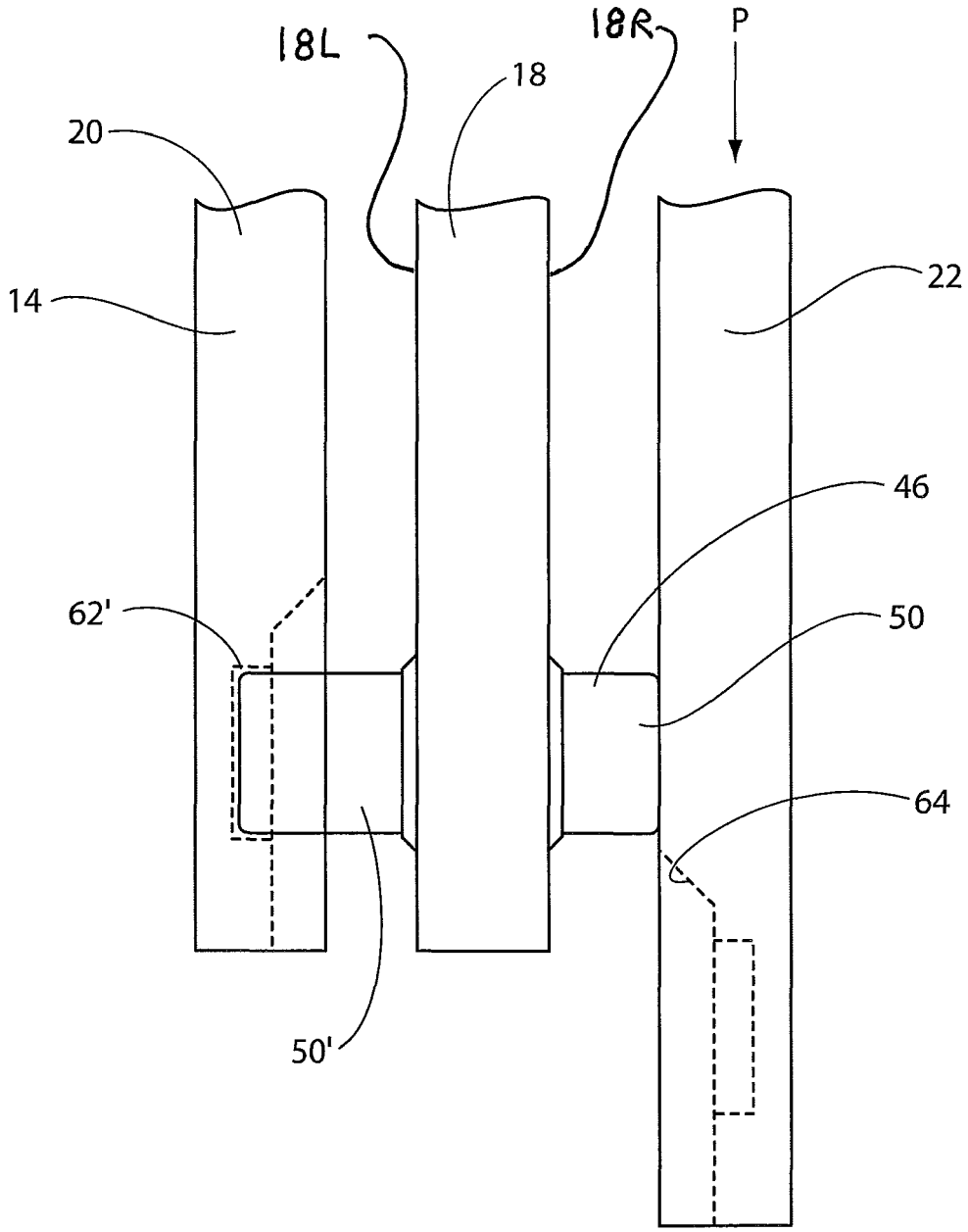
FIG. 17 is a top plan view of the embodiment shown in FIG. 15 with the shuttle pin displaced from the right side.

In another embodiment of the present invention shown in FIGS. 15-17, the inner panel 20 of the left drawer 14 and the inner panel 22 of the right drawer 16 have channels 60, 60'. The channels 60, 60' are hollowed out portions of the panels 20, 22 formed by routing or drilling the material out of the panels 20, 22, or by any other means known in the art. The channels 60, 60' also include holes 62, 62' further recessed within the channels 60, 60' and translational wedges 64, 64' formed by beveling the channels 60, 60' to slope up to the surfaces of the panels 20, 22. The shuttle pin 46 and its pistons 50, 50' are shown as installed in the center panel 18. The holes 62, 62' are adapted to receive the pistons 50, 50' and the wedges 64, 64' are adapted to push the pistons 50, 50' laterally. As shown in FIG. 17, when the right panel 22 is pulled in direction P, the wedge 64 catches and depresses the piston 50 until the piston 50 is flush with the surface of the right panel 22. The shuttle pin 46 is then pushed through the center panel 18 and the piston 50' enters the hole 62' of the left panel 20. Once the piston 50' is engaged with the hole 62', the left drawer 14 is prevented from moving in direction P.

Figure 18:
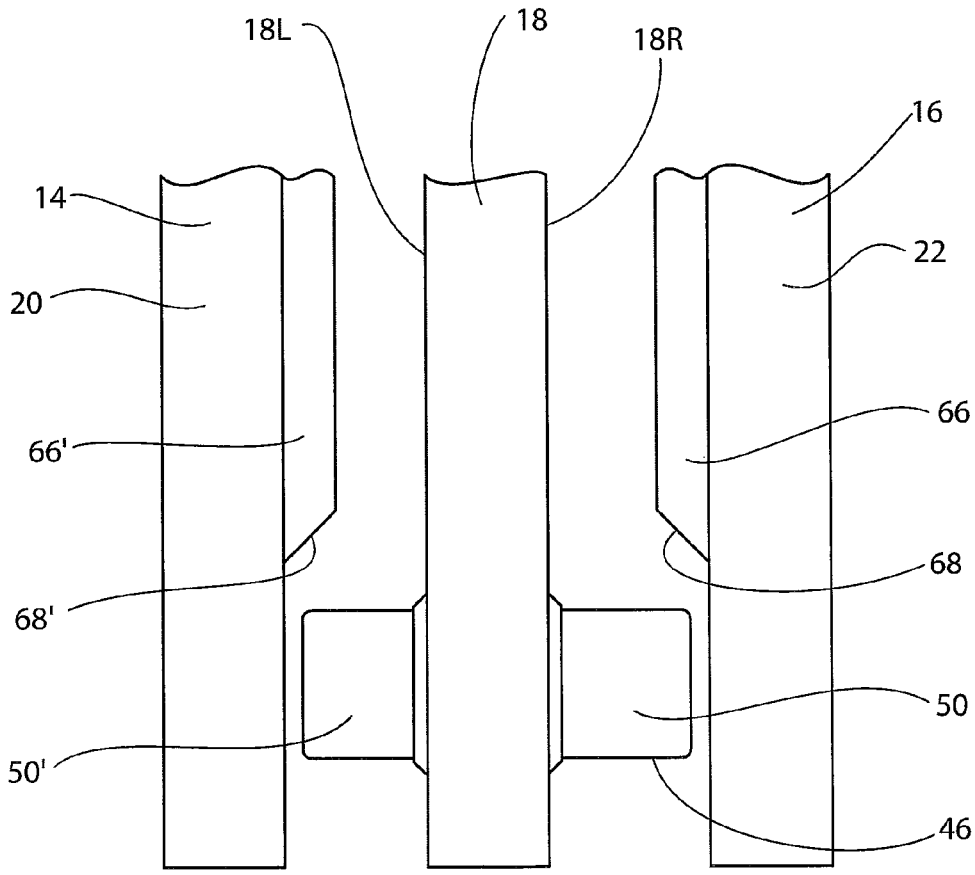
FIG. 18 is a top plan view of another embodiment of the present invention.
Figure 19:
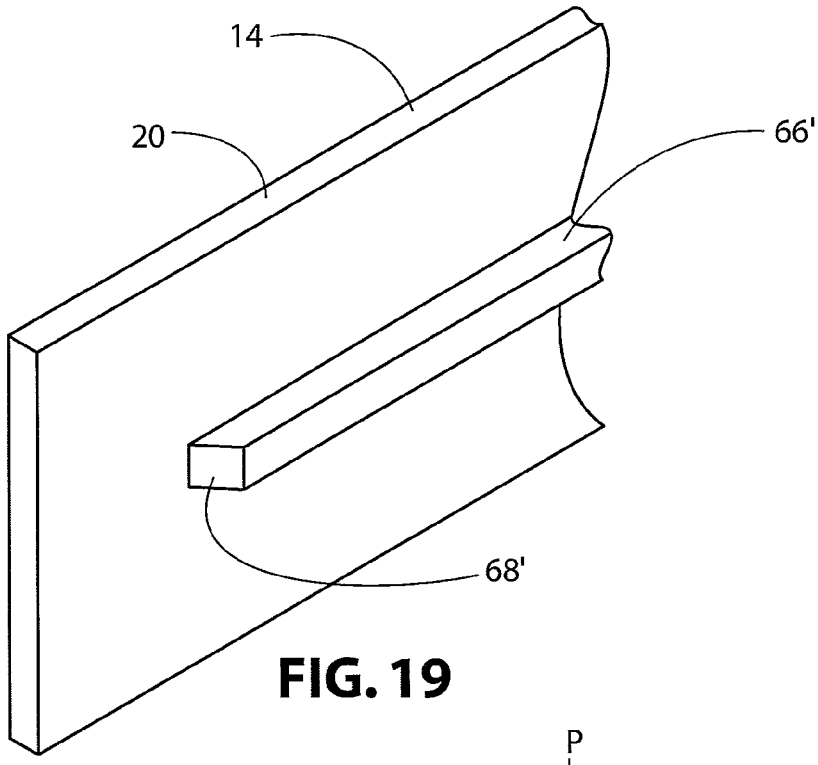
FIG. 19 is a perspective view of a left panel in the embodiment shown in FIG. 18.
Figure 20:
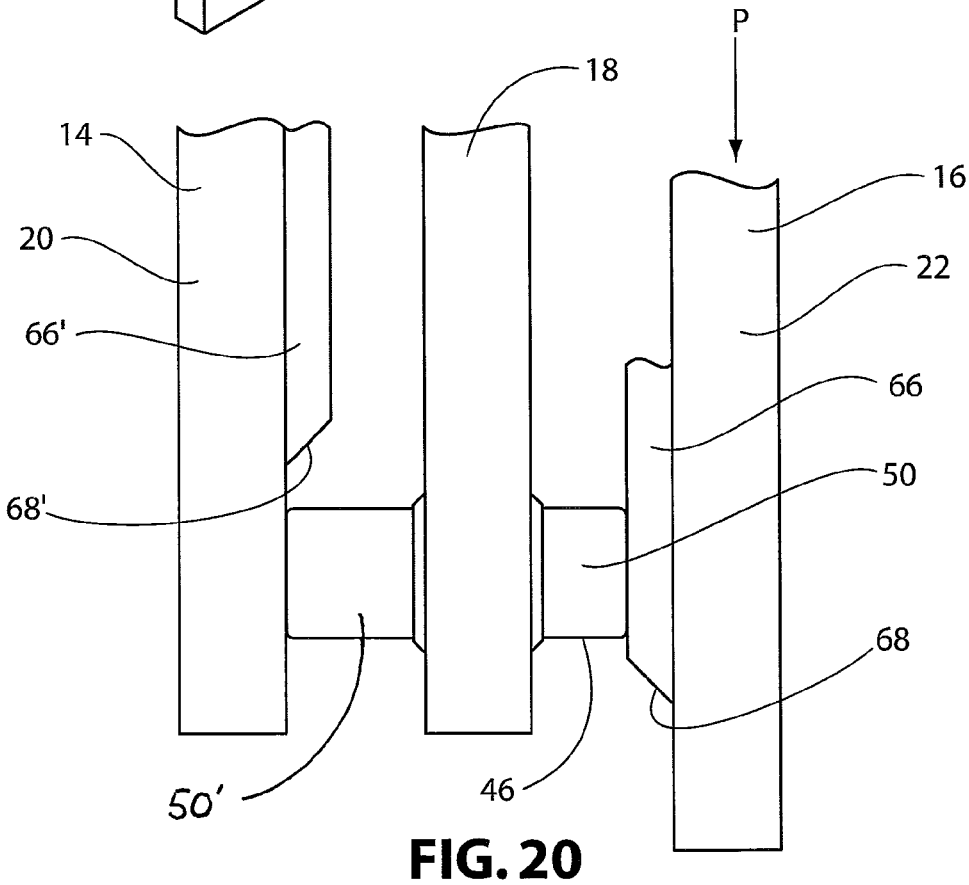
FIG. 20 is a top plan view of the embodiment shown in FIG. 18 with the shuttle pin displaced from the right side.

In another embodiment of the present invention shown in FIGS. 18-20, the inner panels 20, 22 have rails 66, 66' which are attached to the inside of the panels 20, 22 and run lengthwise along them. The rails 66, 66' have translational wedges 68, 68' that taper until they are flush with the panels 20, 22. The rails 66, 66' are configured so that the wedges 68, 68' will depress the pistons 50, 50' of the shuttle pin 46 as they move laterally across the pistons 50, 50'. As shown in FIG. 20, in operation the right panel 22 moves in direction P, causing the wedge 68 to push the piston 50 laterally toward the left panel 20. Once the shuttle pin 46 has been pushed the piston 50' protrudes and the inner panel 20 and wedge 68' of the inner panel 20 will be unable to pass the piston 50' by moving in direction P. This is because the other piston 50 is engaged with the flat portion of the rail 66 on the inner panel 22, and the piston 50' moves into the path of the wedge 68' thereby preventing a motion of the left drawer 14 in the direction of P.

Further, it will be readily appreciated by those skilled in the art that modifications may be made to the invention without departing from the concepts disclosed in the foregoing description. Accordingly, the particular embodiments described in detail herein are illustrative only and are not limited to the scope of the invention, which is to be given the full breadth of the appended claims and any and all equivalents thereof.

The invention claimed is:

1. An anti-tip system for a piece of furniture having horizontally adjacent drawers comprising:

a center panel having a right side, a left side, and an aperture extending through the panel along a longitudinal axis generally perpendicular to each side;

a left drawer having an outside wall adjacent to the left side of the center panel, wherein the outside wall of the left drawer has a left control member attached thereto;

a right drawer having an outside wall adjacent to the right side of the center panel, wherein the outside wall of the right drawer has a right control member attached thereto;

a common shuttle pin extending through the aperture, wherein the shuttle pin has a left end extending from the left side of the center panel and a right end extending from the right side of the center panel; and a left wedge secured to the left side of the center panel and a right wedge secured to the right side of the center panel, whereby when one drawer is open, the shuttle pin is displaced by the wedge associated with the open drawer through the aperture to engage a stop on the closed drawer and prevent motion of the control member associated with the closed drawer, thereby blocking the travel of the closed drawer.

2. The system according to claim 1, wherein the left wedge and the right wedge are rotational wedges and are rotatably attached to the left hand side and the right hand side of the center panel and the control members engage the wedges such that translation of a drawer urges rotation of a respective wedge.

3. The system according to claim 2, wherein the stop for each wedge is an edge surface on the wedge in radial interference with the path of the shuttle pin in the extended position.

4. The system according to claim 2, wherein the stop is a separate element from the wedge and is protruding from the outside wall of each drawer in translational interference with the path of the extended shuttle pin.

5. The system according to claim 2, wherein the rotational wedge has a radially offset post and the control member has an engaging slot such that translation of a drawer translates the control member and engages the post to rotate the wedge.

6. The system according to claim 5, wherein the engaging slot is a u-shaped slot with a front leg longer than a back leg, wherein the back leg rotates the wedge to push the shuttle pin and the front leg releases the wedge to a neutral position.

7. The system according to claim 2, wherein each wedge includes a ramp and a neutral surface generally perpendicular to the shuttle pin aperture axis such that rotation of the wedge beyond the ramp does not further advance the shuttle pin.

8. The system according to claim 7, wherein the rotational wedge has a protrusion past the neutral surface upon which the shuttle pin bumps to limit rotation of the rotational wedge.

9. The system according to claim 1, wherein the left wedge and the right wedge are translational wedges associated with the outside wall of the left and right drawers and the left wedge and right wedge also function as the control members such that translation of one wedge through drawer motion acts as a control member to displace the shuttle pin into the stop of the other drawer to prevent translation of the other drawer.

10. The system according to claim 9, wherein each wedge includes a ramp and a neutral surface generally perpendicular to the shuttle pin aperture axis such that translation of the wedge beyond the ramp does not further advance the shuttle pin.

11. The system according to claim 10, wherein the neutral surface extends the length of the drawer travel.

12. The system according to claim 9, wherein the left wedge and the right wedge are separate parts and secured to the outer walls of the left drawer and the right drawer.

13. The system according to claim 9, wherein the stop is the ramp of each wedge, such that the shuttle pin advanced by one wedge interferes with the drawer travel by abutting against the ramp of the other wedge.

14. The system according to claim 1, wherein the shuttle pin is comprised of a cylinder with two opposing pistons biased in a neutral position and attached by a connecting post such that the compression of one piston urges the other piston from the neutral position and to protrude from the cylinder.

15. The system according to claim 14, wherein in the neutral position, the pistons of the shuttle pin do not contact either wedge.

16. A method for preventing horizontally adjacent drawers of a furniture piece from being simultaneously in the open position, comprising the steps of:

providing a center panel having a right side, a left side, and an aperture extending through the panel along a longitudinal axis generally perpendicular to each side;

providing a left drawer having an outside wall adjacent to the left side of the center panel, wherein the outside wall of the left drawer has a left control member attached thereto;

providing a right drawer having an outside wall adjacent to the right side of the center panel, wherein the outside wall of the right drawer has a right control member attached thereto;

providing a common shuttle pin extending through the aperture, wherein the shuttle pin has a left end extending from the left side of the center panel and a right end extending from the right side of the center panel; and providing a left wedge secured to the left side of the center panel and a right wedge secured to the right side of the center panel, whereby when one drawer is open, the shuttle pin is displaced by the wedge associated with the open drawer through the aperture to engage a stop of the closed drawer and prevent motion of the control member associated with the closed drawer, thereby blocking the travel of the closed drawer.

* * * * *